US009177776B2

(12) United States Patent
Hoyes et al.

(10) Patent No.: US 9,177,776 B2
(45) Date of Patent: Nov. 3, 2015

(54) MASS TO CHARGE RATIO SELECTIVE EJECTION FROM ION GUIDE HAVING SUPPLEMENTAL RF VOLTAGE APPLIED THERETO

(75) Inventors: John Brian Hoyes, Cheshire (GB); Daniel James Kenny, Knutsford (GB); David Langridge, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 13/522,888

(22) PCT Filed: Jan. 18, 2011

(86) PCT No.: PCT/GB2011/050073

§ 371 (c)(1), (2), (4) Date: Oct. 1, 2012

(87) PCT Pub. No.: WO2011/089419

PCT Pub. Date: Jul. 28, 2011

(65) Prior Publication Data

US 2013/0099110 A1 Apr. 25, 2013

Related U.S. Application Data

(60) Provisional application No. 61/298,273, filed on Jan. 26, 2010.

(30) Foreign Application Priority Data

Jan. 19, 2010 (GB) ..... 1000852.2

(51) Int. Cl.

| | |
|---|---|
| ***H01J 49/34*** | (2006.01) |
| ***H01J 49/06*** | (2006.01) |
| ***H01J 49/42*** | (2006.01) |

(52) U.S. Cl.

CPC ..... *H01J 49/34* (2013.01); *H01J 49/065* (2013.01); *H01J 49/429* (2013.01); *H01J 49/4235* (2013.01); *H01J 49/4275* (2013.01)

(58) Field of Classification Search

CPC .... G01N 27/622; H01J 49/062; H01J 49/065; H01J 49/4235; H01J 49/427

USPC ..... 250/281

See application file for complete search history.

(56) References Cited

U.S. PATENT DOCUMENTS

| | | | |
|---|---|---|---|
| 6,177,668 | B1 | 1/2001 | Hager |
| 7,960,694 | B2 | 6/2011 | Hoyes |

(Continued)

FOREIGN PATENT DOCUMENTS

| | | |
|---|---|---|
| GB | 2437829 | 11/2007 |
| GB | 2440613 | 2/2008 |

(Continued)

OTHER PUBLICATIONS

Gerlich, "*Inhomogeneous RF Fields: A Versatile Tool for the Study of Processes with Slow Ions*", Adv. In Chem. Phys. Ser., vol. 82, Ch. 1, pp. 1-176, 1992.

*Primary Examiner* — Jack Berman
*Assistant Examiner* — Kevin Chung
(74) *Attorney, Agent, or Firm* — Diederiks & Whitelaw, PLC

(57) ABSTRACT

An ion guide is disclosed wherein an axial DC voltage barrier is created at the exit of the ion guide. A primary RF voltage is applied to the electrodes in order to confine ions radially within the ion guide. A supplemental RF voltage is also applied to the electrodes. The supplemental RF voltage has a greater axial repeat length than that of the primary RF voltage. The amplitude of the supplemental RF voltage is increased with time causing ions to become unstable and gain sufficient axial kinetic energy such that the ions overcome the axial DC voltage barrier. Ions emerge axially from the ion guide in mass to charge ratio order.

17 Claims, 5 Drawing Sheets

(56) References Cited

U.S. PATENT DOCUMENTS

| | | | | |
|---|---|---|---|---|
| 2003/0001085 | A1* | 1/2003 | Bateman et al. | 250/281 |
| 2004/0079874 | A1* | 4/2004 | Bateman et al. | 250/281 |
| 2007/0034810 | A1 | 2/2007 | Hoyes | |
| 2007/0278399 | A1* | 12/2007 | Kim et al. | 250/288 |
| 2009/0014637 | A1* | 1/2009 | Giles et al. | 250/281 |
| 2009/0121123 | A1* | 5/2009 | Giles et al. | 250/282 |
| 2009/0134321 | A1* | 5/2009 | Hoyes | 250/282 |
| 2009/0294641 | A1* | 12/2009 | Konicek et al. | 250/281 |
| 2009/0302209 | A1* | 12/2009 | Green et al. | 250/282 |
| 2009/0314935 | A1 | 12/2009 | Hoyes | |

FOREIGN PATENT DOCUMENTS

| | | | | |
|---|---|---|---|---|
| JP | 2002517888 | | 6/1999 | |
| JP | 2008546147 | | 6/2006 | |
| WO | 2006/075182 | | 7/2006 | |
| WO | 2006/075189 | | 7/2006 | |
| WO | 2007/010272 | | 1/2007 | |
| WO | WO 2007/125354 | A2 * | 11/2007 | H01J 49/28 |
| WO | WO 2008007069 | A2 * | 1/2008 | |
| WO | 2008/068515 | | 6/2008 | |
| WO | 2009/110025 | | 9/2009 | |

* cited by examiner

MASS TO CHARGE RATIO SELECTIVE EJECTION FROM ION GUIDE HAVING SUPPLEMENTAL RF VOLTAGE APPLIED THERETO

CROSS-REFERENCE TO RELATED APPLICATION

This application represents a National Stage application of PCT/GB2011/050073 entitled "Mass to Charge Ratio Selective Ejection from Ion Guide Having Supplemental RF Voltage Applied Thereto" filed 18 Jan. 2011 which claims priority from and the benefit of U.S. Provisional Patent Application Ser. No. 61/298273 filed on 26 Jan. 2010 and United Kingdom Patent Application No. 1000852.2 filed on 19 Jan. 2010. The entire contents of these applications are incorporated herein by reference.

The present invention relates to an ion guide, a mass spectrometer, a method of guiding ions and a method of mass spectrometry.

BACKGROUND TO THE PRESENT INVENTION

It is a common requirement in a mass spectrometer for ions to be transferred through a region maintained at an intermediate pressure i.e. at a pressure wherein collisions between ions and gas molecules are likely to occur as ions transit through an ion guide. Ions may need to be transported, for example, from an ionisation region which is maintained at a relatively high pressure to a mass analyser which is maintained at a relatively low pressure. It is known to use a radio frequency (RF) transportion guide operating at an intermediate pressure of around $10^{-3}$ to $10^{-1}$ mbar to transportions through a region maintained at an intermediate pressure. It is also well known that the time averaged force on a charged particle or ion due to an AC inhomogeneous electric field is such as to accelerate the charged particle or ion to a region where the electric field is weaker. A minimum in the electric field is commonly referred to as a pseudo-potential well or valley. Known RF ion guides are designed to exploit this phenomenon by creating a pseudo-potential well wherein the minimum of the pseudo-potential well lies along the central axis of the ion guide and wherein ions are confined radially within the ion guide.

It is known to use an RF ion guide to confine ions radially and to subject the ions to Collision Induced Dissociation or fragmentation within the ion guide. Fragmentation of ions is typically carried out at pressures in the range $10^{-3}$ to $10^{-1}$ mbar either within an RF ion guide or within a dedicated gas collision cell.

It is also known to use an RF ion guide to confine ions radially within an ion mobility separator or spectrometer. Ion mobility separation with RF confinement may be carried out at pressures in the range $10^{-1}$ to 10 mbar.

Different forms of RF ion guide are known including a multi-pole rod set ion guide and a ring stack or ion tunnel ion guide. A ring stack or ion tunnel ion guide comprises a stacked ring electrode set wherein opposite phases of an RF voltage are applied to adjacent electrodes. A pseudo-potential well is formed wherein the minimum of the pseudo-potential well lies along the central axis of the ion guide. Ions are confined radially within the ion guide. The ion guide has a relatively high transmission efficiency.

It is known that ion guides and ion tunnels may also be used as linear ion traps.

Ion trapping devices are widely used in mass spectrometry both as components in tandem instruments and as standalone analytical devices. There are several different types of conventional analytical traps including 3D ion traps, Paul ion traps, 2D ion traps, linear ion traps, Orbitrap® devices and FTICR devices.

Most of these devices are high resolution devices. However, there are many applications where a simple low resolution ion trap will be of great benefit. For example, if the second quadrupole (MS2) of a tandem quadrupole mass spectrometer is operated in a scanning mode then the duty-cycle of the instrument will be dramatically reduced, since the narrow resolving mass window of the second quadrupole must be scanned over the desired mass range. If mass selective ejection of ions from the collision cell is synchronised with the scanned mass window of the second quadrupole then the duty-cycle can be significantly increased.

It is desired to provide an improved ion guide.

SUMMARY OF THE PRESENT INVENTION

According to an aspect of the present invention there is provided an ion guide comprising:

a plurality of electrodes;

a first device arranged and adapted to apply a first RF voltage to at least some of the electrodes; and a second device arranged and adapted to apply one or more DC and/or AC or RF voltages to one or more electrodes in order to create one or more axial DC and/or AC or RF voltage barriers so as to confine at least some ions axially within the ion guide;

wherein the ion guide further comprises:

a third device arranged and adapted to apply a second RF voltage to at least some of the electrodes, wherein two or more adjacent electrodes are maintained at the same first RF phase of the second RF voltage and two or more subsequent adjacent electrodes are maintained at the same second RF phase of the second RF voltage, the first RF phase of the second RF voltage being different from or opposite to the second RF phase of the second RF voltage; and a fourth device arranged and adapted to progressively increase, progressively decrease, progressively vary, scan, linearly increase, linearly decrease, increase in a stepped, progressive or other manner or decrease in a stepped, progressive or other manner the amplitude, height or depth and/or frequency of either the first RF voltage and/or the second RF voltage such that at least some of the ions overcome the one or more axial DC and/or AC or RF voltage barriers and emerge axially from the ion guide.

The fourth device is preferably arranged and adapted to ramp, increase, decrease, vary or alter either the first RF voltage and/or the second RF voltage so as to cause at least some ions within the ion guide to become unstable and to gain sufficient axial kinetic energy so as to overcome the one or more axial DC and/or AC or RF voltage barriers.

The first device is preferably arranged and adapted to apply the first RF voltage such that either:

(i) adjacent electrodes are maintained at opposite RF phases; or (ii) two, three, four or more adjacent electrodes are maintained at the same first RF phase of the first RF voltage and two, three, four or more subsequent adjacent electrodes are maintained at the same second RF phase of the first RF voltage, wherein the first RF phase of the first RF voltage is different or opposite to the second RF phase of the first RF voltage and wherein two, three, four or more adjacent electrodes are maintained at the same first RF phase of the second RF voltage and two, three, four or more subsequent adjacent electrodes are maintained at the same second RF phase of the second RF voltage.

The first device preferably applies the first RF voltage to at least some of the electrodes with a first RF repeat unit, pattern or length and the third device applies the second RF voltage to at least some of the electrodes with a second RF repeat unit, pattern or length, wherein the second RF repeat unit, pattern or length is greater than the first RF repeat unit, pattern or length.

The fourth device is preferably arranged and adapted to cause ions to emerge axially from the ion guide substantially in order of their mass to charge ratio or in a mass to charge ratio dependent manner.

The ion guide preferably comprises either:

(i) an ion tunnel ion guide comprising a plurality of electrodes each having an aperture through which ions are transmitted in use; or (ii) a segmented multipole rod set ion guide.

According to an embodiment the ion guide preferably further comprises a device arranged and adapted to drive or urge ions along at least a portion of the axial length of the ion guide.

The device for driving or urging ions preferably comprises a device for applying one more transient DC voltages or potentials or one or more DC voltage or potential waveforms to at least some or at least 1%, 5%, 10%, 20%, 30%, 40%, 50%, 60%, 70%, 80%, 90%, 95% or 100% of the electrodes.

In a mode of operation ions having mass to charge ratios ≥M1 preferably exit the ion guide whilst ions having mass to charge ratios <M2 are axially trapped or confined within the ion guide by the one or more DC and/or AC or RF voltage barriers, wherein M1 falls within a first range selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; and (xi) >1000 and wherein M2 falls with a second range selected from the group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; and (xi) >1000.

According to another aspect of the present invention there is provided a mass spectrometer comprising an ion guide as described above.

The mass spectrometer preferably further comprises a mass analyser or other device which is scanned in synchronism with the mass to charge ratio selective ejection of ions from the ion guide.

According to another aspect of the present invention there is provided a method of guiding ions comprising:

providing an ion guide comprising a plurality of electrodes;

applying a first RF voltage to at least some of the electrodes; and applying one or more DC and/or AC or RF voltages to one or more electrodes in order to create one or more axial DC and/or AC or RF voltage barriers so as to confine at least some ions axially within the ion guide;

wherein the method further comprises:

applying a second RF voltage to at least some of the electrodes, wherein two or more adjacent electrodes are maintained at the same first RF phase of the second RF voltage and two or more different adjacent electrodes are maintained at the same second RF phase of the second RF voltage, the first RF phase of the second RF voltage being different from the second RF phase of the second RF voltage; and progressively increasing, progressively decreasing, progressively varying, scanning, linearly increasing, linearly decreasing, increasing in a stepped, progressive or other manner or decreasing in a stepped, progressive or other manner the amplitude, height or depth and/or frequency of either the first RF voltage and/or the second RF voltage such that at least some of the ions overcome the one or more axial DC and/or AC or RF voltage barriers and emerge axially from the ion guide.

According to another aspect of the present invention there is provided a method of mass spectrometry comprising a method of guiding ions as described above.

According to another aspect of the present invention there is provided a mass analyser comprising:

a plurality of electrodes;

a device arranged and adapted to apply a primary RF voltage and a supplemental RF voltage to at least some of the electrodes, wherein the supplemental RF voltage is applied to the electrodes with an axial repeat unit, pattern or length which is greater than that of the primary RF voltage;

a device arranged and adapted to maintain an axial voltage barrier at a position along the mass analyser; and a device arranged and adapted to progressively increase the amplitude of the supplemental RF voltage so as to cause ions progressively to overcome the axial voltage barrier.

According to another aspect of the present invention there is provided a method of mass analysing ions comprising:

providing a mass analyser comprising a plurality of electrodes;

applying a primary RF voltage and a supplemental RF voltage to at least some of the electrodes, wherein the supplemental RF voltage is applied to the electrodes with an axial repeat unit, pattern or length which is greater than that of the primary RF voltage;

maintaining an axial voltage barrier at a position along the mass analyser; and progressively increasing the amplitude of the supplemental RF voltage so as to cause ions progressively to overcome the axial voltage barrier.

According to the preferred embodiment a segmented ion guide is provided. An RF voltage is preferably applied to the electrodes in order to confine ions radially within the ion guide. One or more DC (or RF) axial barrier voltages are preferably applied or maintained along the length of the ion guide in order to trap or confine ions axially within the ion guide. A supplemental RF voltage is preferably applied to the electrodes. The supplemental RF voltage preferably has a significantly larger axial effective potential component compared to the radial effective potential component. The supplemental RF voltage is preferably ramped over a period of time causing ions within the ion guide to become unstable in a mass-dependent manner. Axial energy imparted in this process is preferably sufficient to cause ions to be ejected over the axial barrier and thus give mass-selective axial ejection of the ions from the device.

The preferred embodiment relates to a segmented ion guide in which ions can be accumulated and ejected in a mass-selective fashion. A confining RF voltage is applied to give radial confinement as per a conventional segmented RF ion guide. Barrier voltages are applied to confine ions axially. Ions are preferably concentrated near the exit end of the device. A supplemental RF voltage is applied, preferably with an increased ratio of axial effective potential component to radial effective potential component than that of the confining RF voltage alone. The supplemental RF voltage is preferably ramped upwards or increased over the scan time.

From Gerlich (Gerlich, "Inhomogeneous RF Fields: A Versatile Tool For the Study of Processes With Slow Ions", Adv. In Chem. Phys. Ser., vol. 82, Ch. 1, pp. 1-176, 1992) the adiabaticity parameter for ions within an RF field with a single applied RF voltage is proportional to the applied voltage and inversely proportional to the mass of the ion. Therefore, if it is assumed that the adiabaticity is due to the supplemental RF voltage alone, then as the supplemental RF voltage is increased the ions become unstable in mass order starting with the lowest mass ions. This assumption is reasonable since the confining RF voltage and frequency is such that it has a minimal contribution to the adiabaticity parameter.

As ions become unstable they gain kinetic energy from the RF voltage. The larger ratio of axial to radial field components of the supplemental RF voltage leads to a significant axial kinetic energy increase. This effect, coupled with the strong radial confinement and relatively weak axial barrier means that the ions gain sufficient axial energy to exit the device axially, while still being confined radially. Thus ions are ejected axially from the device in increasing mass order.

According to an embodiment the apparatus preferably further comprises:

(a) an ion source selected from the group consisting of: (i) an Electrospray ionisation ("ESI") ion source; (ii) an Atmospheric Pressure Photolonisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions; and/or (l) a device for converting a substantially continuous ion beam into a pulsed ion beam.

The mass spectrometer preferably further comprises either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to the preferred embodiment the one or more transient DC voltages or potentials or the one or more DC voltage or potential waveforms create: (i) a potential hill or barrier; (ii) a potential well; (iii) multiple potential hills or barriers; (iv) multiple potential wells; (v) a combination of a potential hill or barrier and a potential well; or (vi) a combination of multiple potential hills or barriers and multiple potential wells.

The one or more transient DC voltage or potential waveforms preferably comprise a repeating waveform or square wave.

A plurality of axial DC potential wells are preferably translated along at least a portion of the length of the ion guide or a plurality of transient DC potentials or voltages are progressively applied to electrodes along the axial length of the ion guide.

The first and/or second RF voltages preferably have an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; (xi) 500-550 V peak to peak; (xxii) 550-600 V peak to peak; (xxiii) 600-650 V peak to peak; (xxiv) 650-700 V peak to peak; (xxv) 700-750 V peak to peak; (xxvi) 750-800 V peak to peak; (xxvii) 800-850 V peak to peak; (xxviii) 850-900 V peak to peak; (xxix) 900-950 V peak to peak; (xxx) 950-1000 V peak to peak; and (xxxi) >1000 V peak to peak.

The first and/or second RF voltages preferably have a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The ion guide preferably further comprises a device for maintaining in a mode of operation the ion guide at a pressure selected from the group consisting of: (i) $<1.0\times10^{-1}$ mbar; (ii) $<1.0\times10^{-2}$ mbar; (iii) $<1.0\times10^{-3}$ mbar; and (iv) $<1.0\times10^{-4}$ mbar. According to another embodiment the ion guide preferably further comprises a device for maintaining in a mode of operation the ion guide at a pressure selected from the group consisting of: (i) $>1.0\times10^{-3}$ mbar; (ii) $>1.0\times10^{-2}$ mbar; (iii) $>1.0\times10^{-1}$ mbar; (iv) >1 mbar; (v)>10 mbar; (vi) >100 mbar; (vii) $>5.0\times10^{-3}$ mbar; (viii) $>5.0\times10^{-2}$ mbar; (ix) $10^{-4}$-$10^{-3}$ mbar; (x) $10^{-3}$-$10^{-2}$ mbar; and (xi) $10^{-2}$-$10^{-1}$ mbar.

According to the preferred embodiment in a mode of operation ions are arranged to be trapped but are not substantially fragmented within the ion guide. According to an embodiment ions may be collisionally cooled or substantially thermalised within the ion guide.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENT

A preferred embodiment of the present invention will now be described with reference to FIG. 1. According to the preferred embodiment a stacked ring ion guide comprising a plurality of electrodes 101,102,103,104 is provided. Each electrode 101,102,103,104 forming the stacked ring ion guide preferably has an aperture through which ions are transmitted in use.

A primary RF voltage is preferably applied to the electrodes 101,102,103,104 forming the ion guide. Opposite phases of the primary RF voltage are preferably applied to adjacent electrodes so that there is a phase difference of 180° between adjacent electrodes. The primary RF voltage applied to the electrodes 101,102,103,104 results in a radial pseudo-potential barrier being formed which acts to confine ions radially within the ion guide.

Figure 1:
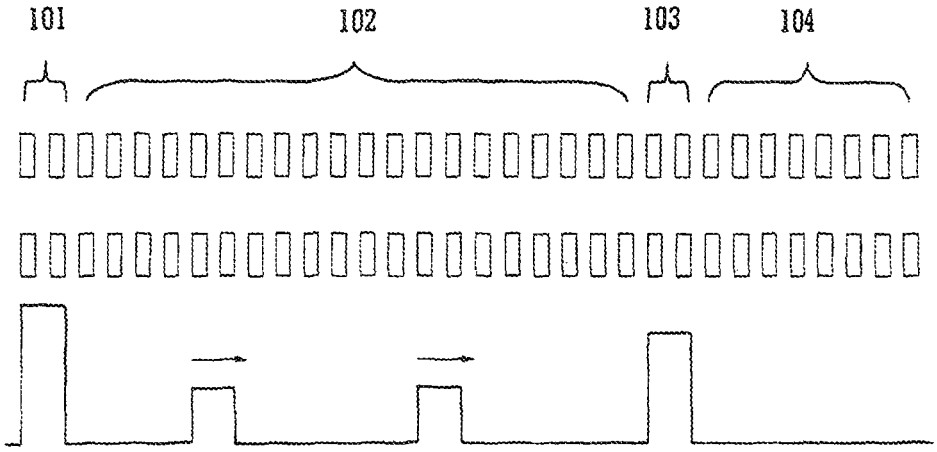
FIG. 1 shows an ion guide according to a preferred embodiment of the present invention together with a DC voltage profile.

FIG. 1 also shows a DC voltage trace and illustrates DC potentials which are preferably applied to the electrodes 101, 102,103,104.

As shown in FIG. 1, according to an embodiment a pair of plates or electrodes 101 towards the entrance of the ion guide is preferably applied within a DC voltage so that a DC potential barrier is created at the entrance to the ion guide. The DC potential barrier preferably prevents ions from exiting the ion guide via the entrance to the ion guide i.e. in a negative axial direction.

An intermediate ion guide region 102 is provided downstream of the electrodes 101 arranged at the entrance to the ion guide. A travelling wave DC voltage pulse comprising one or more transient DC voltages or potentials is preferably applied to the electrodes which form the intermediate ion guide region 102. As a result, ions within the ion guide are preferably translated along the length of the ion guide from the entrance region of the ion guide towards an exit region of the ion guide. The travelling DC voltage wave preferably moves in a positive axial direction as indicated by the arrows shown in FIG. 1 towards the exit of the ion guide. Ions are preferably urged or propelled along the length of the ion guide towards the exit of the ion guide by the one or more transient DC voltages applied to the electrodes 102.

At the exit region of the ion guide a second pair of plates or electrodes 103 are preferably supplied with a DC voltage or potential so that a second DC voltage or potential barrier is formed. The DC barrier voltage or potential at the exit region of the ion guide preferably acts to prevent ions from exiting the ion guide in the positive axial direction under the influence of the DC travelling wave alone. The DC travelling wave in combination with the DC barrier voltage at the exit to the ion guide preferably causes ions to become concentrated close to the exit region of the ion guide.

According to an embodiment an exit/cooling region 104 may be provided downstream of the exit region of the ion guide.

According to the preferred embodiment a supplemental RF voltage is preferably additionally applied to all the plates or electrodes in the entrance region 101 of the ion guide and/or the plates or electrodes provided in the intermediate region 102 of the ion guide and/or the plates or electrodes provided in the exit region 103 of the ion guide. The supplemental RF voltage is preferably applied to the plates or electrodes with a larger axial repeat unit, pattern or length than that of the primary RF voltage.

Figure 2:
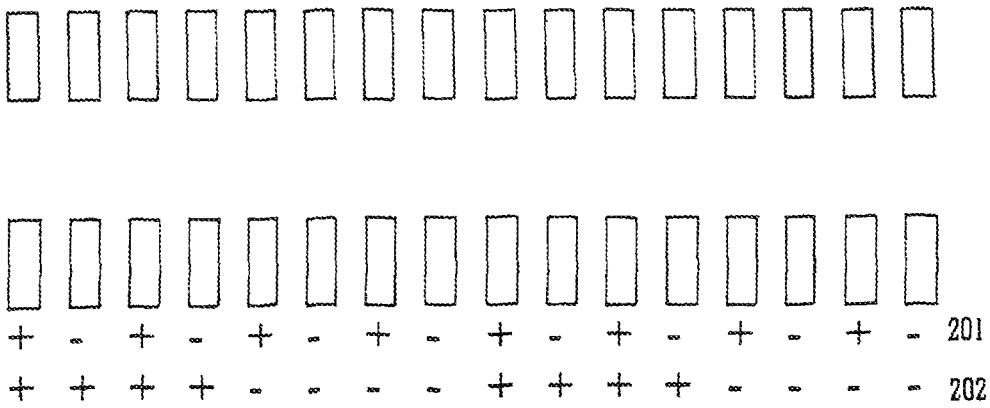
FIG. 2 shows an example of the phase relationship between a primary RF voltage and a supplemental RF voltage which are applied to the electrodes of the ion guide.

FIG. 2 illustrates the different axial repeat units, patterns or lengths of the primary RF voltage 201 and the supplemental RF voltage 202 which is preferably additionally applied to the electrodes of the ion guide. Opposite phases of the primary RF voltage 201 are preferably applied to adjacent electrodes in order to cause ions to be confined radially within the ion guide as shown in FIG. 2. FIG. 2 shows that the supplemental RF voltage 202 is preferably applied to the electrodes with a different axial repeat unit, pattern or length to that of the primary RF voltage 201. The − sign indicates that the RF voltage is 180° out of phase with the RF voltage applied to the electrodes indicated with a + sign. In the example shown in FIG. 2 the repeat unit, pattern or length of the supplemental RF voltage 202 is ++++/−−−− (i.e. four sequential electrodes are maintained at the same phase and the next four electrodes are all maintained 180° out of phase with the first four electrodes).

The increase in the axial repeat unit, pattern or length of the supplemental RF voltage 202 leads to an increase of the axial component of the effective potential from the applied RF voltage relative to the radial component of the applied RF voltage. As a result, the ion guide preferably acts as an ejection region and ions can be ejected from the ion guide in a mass to charge ratio dependent manner.

According to the preferred embodiment the amplitude of the supplemental RF voltage 202 applied to the electrodes is ramped up or increased with time thereby causing some ions to become unstable dependent upon their mass or mass to charge ratio. Ions are caused to become unstable in mass or mass to charge ratio order i.e. ions having relatively low masses or mass to charge ratios will become unstable within the ion guide prior to ions having relatively high masses or mass to charge ratios. As the ions become unstable the ions gain axial energy from the supplemental RF voltage 202. The axial energy which is gained by the ions which have become unstable is sufficient to cause the ions to surmount the axial DC barrier which is provided at the exit of the ion guide. As a result, the ion guide acts as a mass analyser and ions are progressively ejected from the ion guide or mass analyser in order of the mass to charge ratio of the ions as the amplitude of the supplemental RF voltage 202 is increased.

The axial energy which ions gain is preferably insufficient to enable the ions to overcome the radial pseudo-potential barrier which acts to confine ions radially within the ion guide. As a result, the ions escape or pass over the exit barrier 103 provided at the exit region of the ion guide and the ions may then pass into the optional exit/cooling region 104. Ions received in the exit/cooling region 104 may then pass to a downstream device which may, for example, comprise a quadrupole mass analyser or another device.

According to an embodiment a collision cell may be provided upstream of the ion guide. Ions may be accumulated within the collision cell whilst a mass or mass to charge ratio-selective scan is being performed within the preferred ion guide.

According to an embodiment the primary RF voltage 201 may be applied to the electrodes with opposite phases applied to alternate electrodes. The primary RF voltage 201 may have an amplitude of 400V peak-peak and a frequency of 2.65 MHz. The supplemental RF voltage may have a frequency of 1.3 MHz and may be scanned at a rate of 25 V/ms. The supplemental RF voltage may have a repeat unit, pattern or length of +++/−−− (i.e. three sequential electrodes are maintained at the same phase and the next three electrodes are maintained 180° out of phase with the first three electrodes). The axial DC barrier 101 at the entrance to the ion guide and/or the axial DC barrier 103 at the exit of the ion guide may be set at 3V. The optimum travelling wave pulse speed and amplitude of the DC travelling wave may be set dependent upon the gas pressure within the ion guide.

Figure 3:
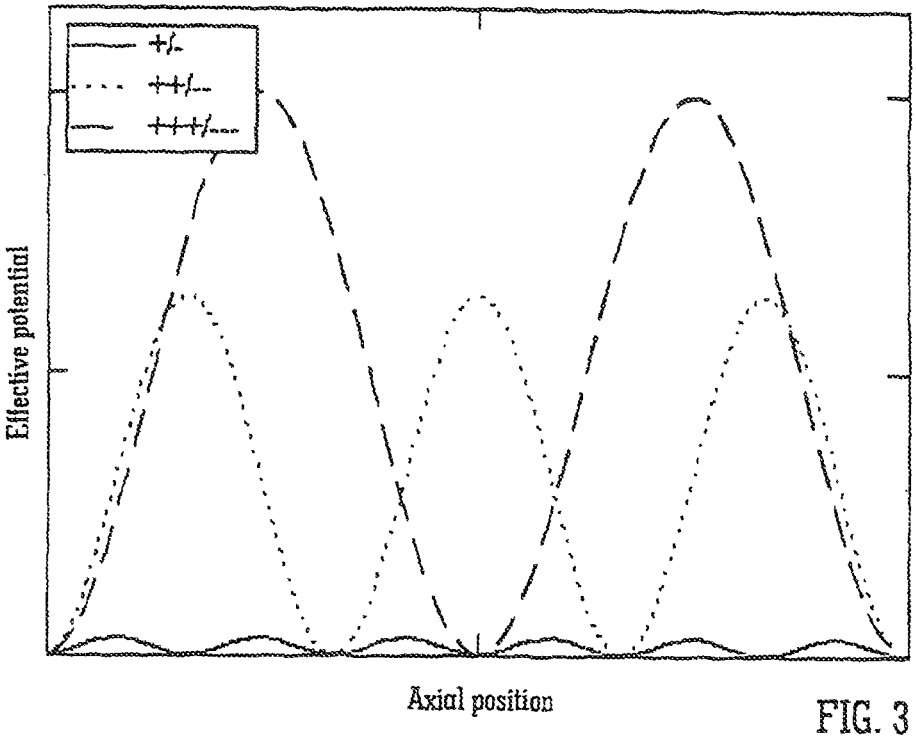
FIG. 3 shows how the effective axial potential varies along the axial length of the ion guide for different supplemental RF repeat units, patterns or lengths.

FIG. 3 shows the effective axial potential within the ion guide or mass analyser according to an embodiment of the present invention as a function of axial position along the central axis of a stacked ring device. The effective axial potential is shown for different repeat units, patterns or lengths of the supplemental RF voltage. FIG. 3 shows the effective potential for RF repeat units, patterns or lengths corresponding to +/−, ++/−− and +++/−−−. As can be seen from FIG. 3, the magnitude of the axial RF voltage component of the effective potential increases as the repeat unit, pattern or length is increased or lengthened.

Figure 4:
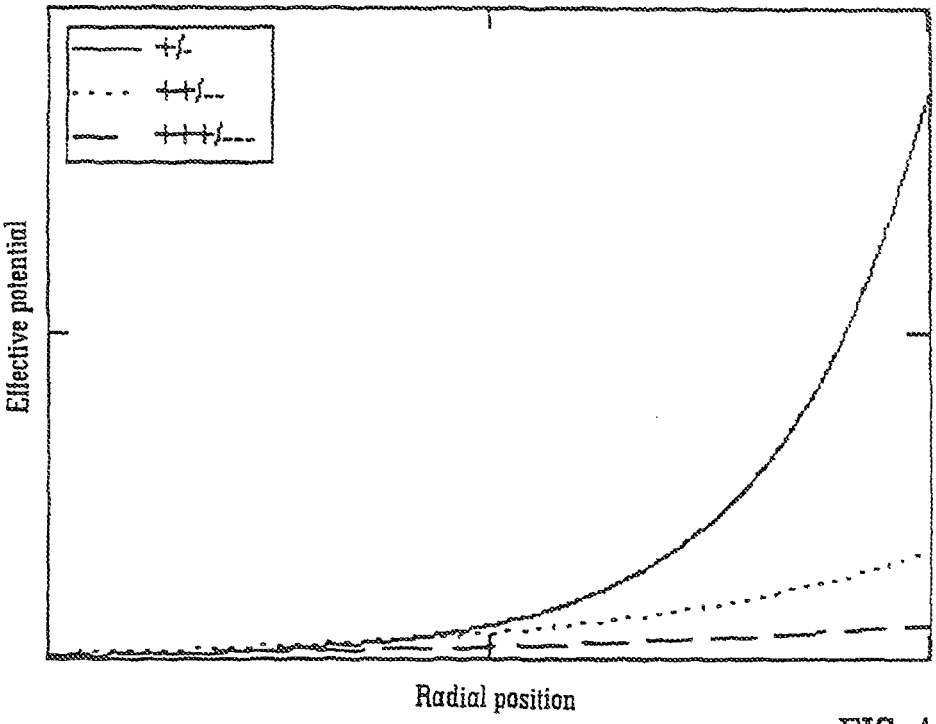
FIG. 4 shows how the effective radial potential varies in the radial direction for different supplemental RF repeat units, patterns or lengths.

FIG. 4 shows the corresponding effective radial potential as a function of radial position in a stacked ring device for supplemental RF repeat units, patterns or lengths corresponding to +/−, ++/−− and +++/−−−. It is apparent from FIG. 4 that the magnitude of the radial component of the effective potential decreases as the RF repeat unit, pattern or length is increased or lengthened.

Figure 5:
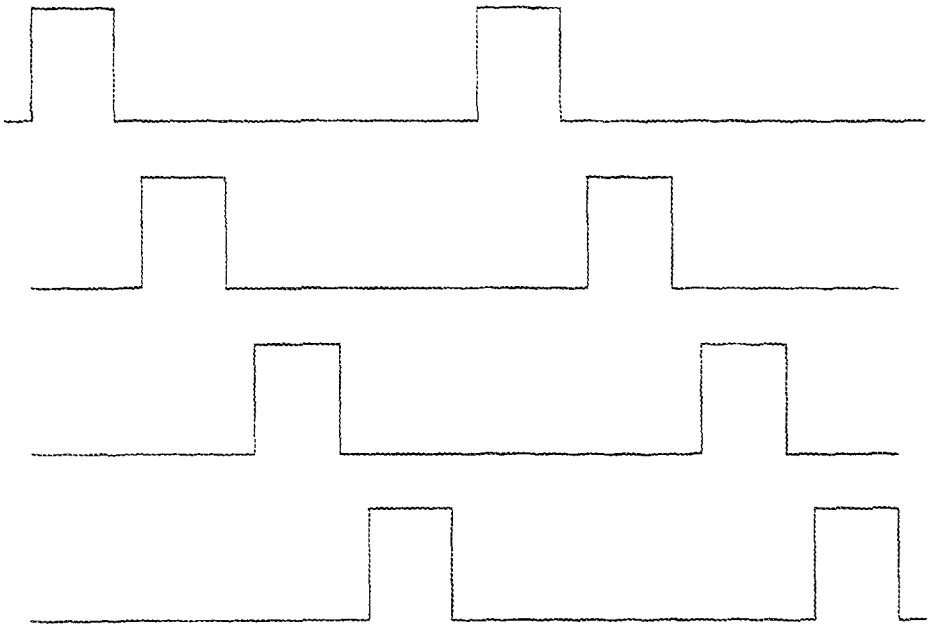
FIG. 5 shows a DC voltage profile of a four repeat unit travelling wave DC pulse which may be applied to the electrodes of the ion guide according to an embodiment of the present invention.

FIG. 5 shows the time evolution of DC voltage pulses which may be applied to the electrodes of the ion guide for a four repeat unit travelling wave pulse according to an embodiment of the present invention.

Figure 6:
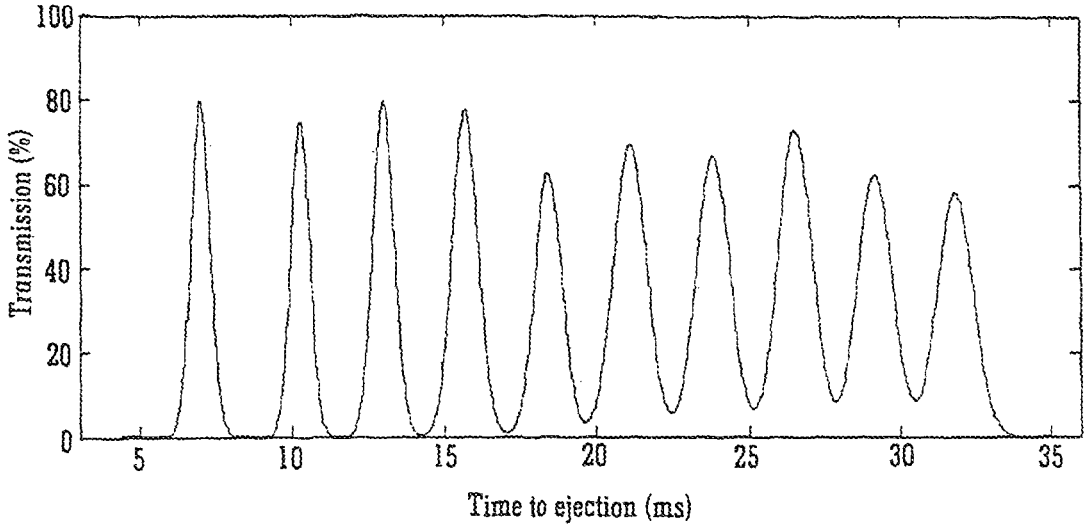
FIG. 6 shows calculated ejection time peaks from a SIMION® model of an embodiment wherein a supplemental RF voltage is applied to the electrodes with a ++/−− RF repeat unit, pattern or length.

FIG. 6 shows the results from a SIMION® modelling of the ejection of times of ions from a preferred ion guide or mass analyser when a supplemental RF voltage was applied to the electrodes of the ion guide with a ++/−− RF repeat unit, pattern or length. The ions were modelled as having masses of 100, 200, 300, 400, 500, 600, 700, 800, 900 and 1000 Da. The axial potential barrier was modelled as being 3V, the main RF voltage was modelled as having an amplitude of 200 $V_{0-p}$ and a frequency of 2.7 MHz, the supplemental RF voltage was modelled as being supplied at a frequency of 700 kHz and the buffer gas was modelled as being maintained at a pressure of 0.05 torr (0.06 mbar) nitrogen (hard sphere collision model). Ion peaks are shown in FIG. 6 as having a Gaussian distribution from the calculated mean and standard deviation of the ion ejection times. The height of the peaks indicates the transmission i.e. percentage of ions that successfully exit the device.

Figure 7:
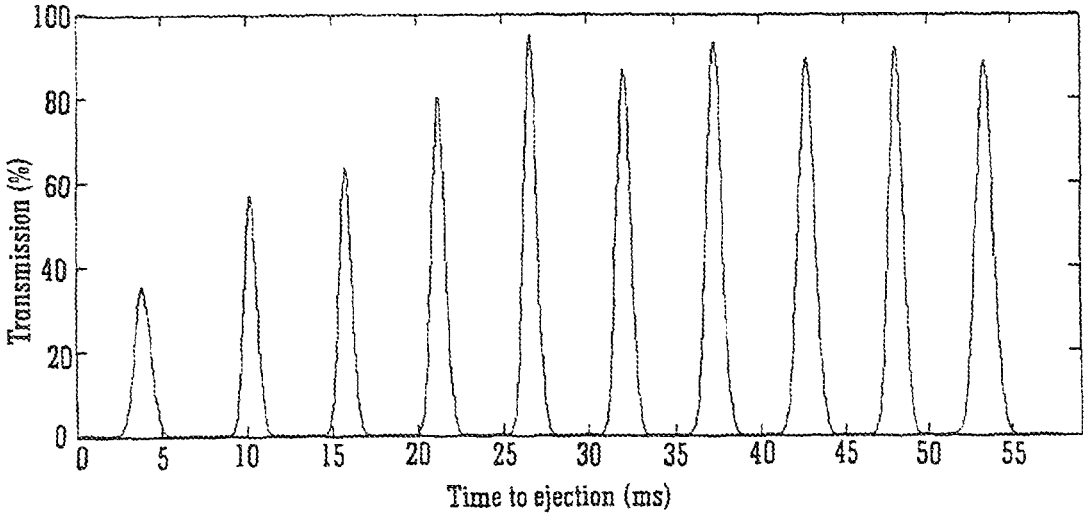
FIG. 7 shows calculated ejection time peaks from a SIMION® model of an embodiment wherein a supplemental RF voltage is applied to the electrodes with a +++/−−− RF repeat unit, pattern or length.

FIG. 7 shows the results from a SIMION® modelling of a preferred ion guide wherein the supplemental RF voltage was applied to the electrodes with a larger +++/−−− repeat unit, pattern or length than the example described above with reference to FIG. 6. Ions having masses of 100, 200, 300, 400, 500, 600, 700, 800, 900 and 1000 Da were modelled as being initially provided within the ion guide. The axial potential barrier was modelled as being 3V, the main RF voltage was maintained at 200 $V_{0-p}$ and a frequency of 2.7 MHz. The frequency of the supplemental RF voltage was modelled as being increased to a frequency of 1.3 MHz. The buffer gas was modelled as being maintained at a pressure of 0.05 torr (0.06 mbar) argon (hard sphere collision model). Ion peaks are shown in FIG. 7 as having a Gaussian distribution from the calculated mean and standard deviation of the ion ejection times. The height of the peaks indicates the transmission i.e. percentage of ions that successfully exit the device.

Figure 8:
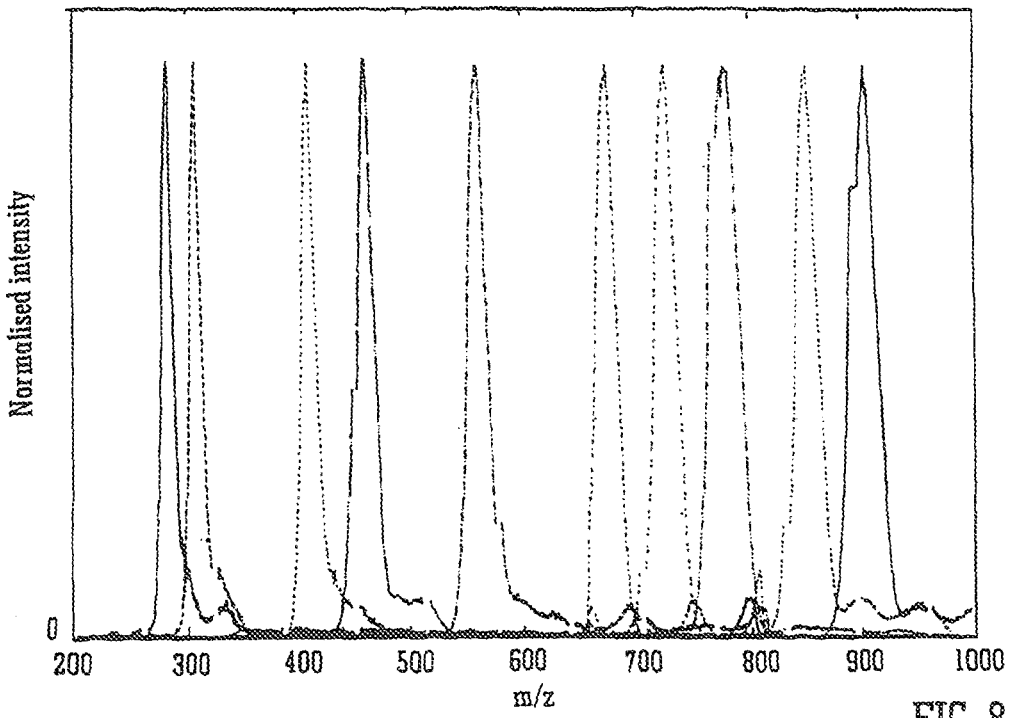
FIG. 8 shows experimental peaks (normalised intensity versus ejection mass) obtained when a supplemental RF voltage was applied to the electrodes of an ion guide with a ++/−− RF repeat unit, pattern or length and with helium as a buffer gas.
Figure 9:
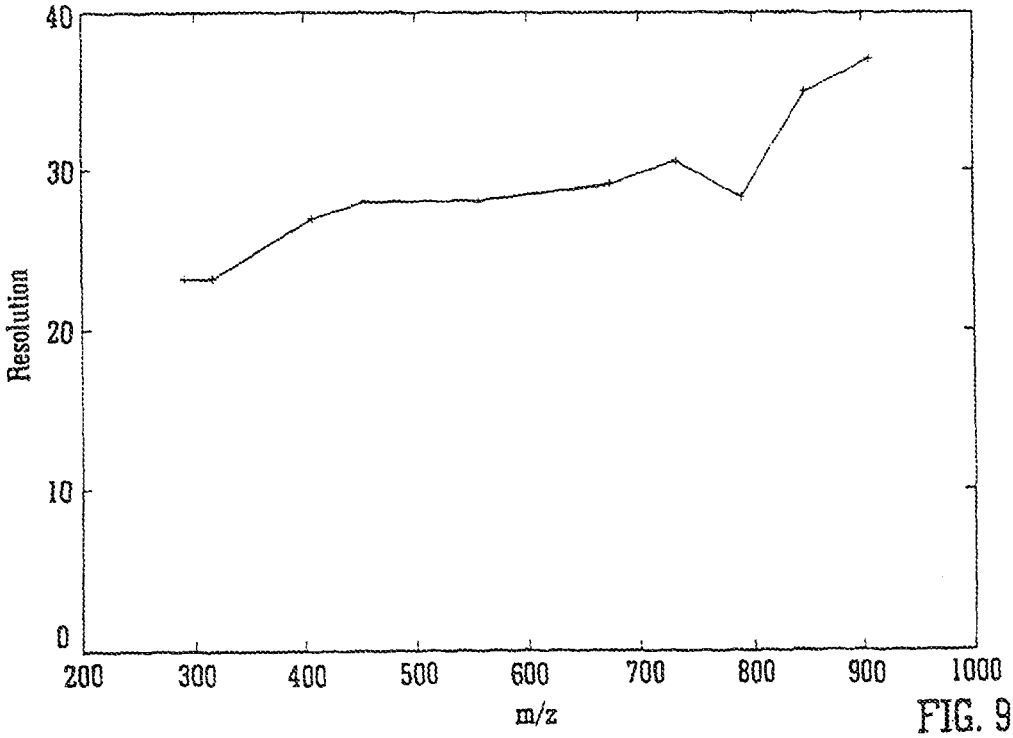
FIG. 9 shows the experimental resolution of the ion guide wherein a supplemental RF voltage was applied to the electrodes of the ion guide with a ++/−− RF repeat unit, pattern or length and with helium as a buffer gas.

FIGS. 8 and 9 show experimental data obtained according to an embodiment of the present invention wherein a supplemental RF voltage was applied to the electrodes of the preferred ion guide with a ++/−− RF repeat unit, pattern or length. A 5V barrier was applied to the exit electrodes in order to confine ions axially within the ion guide. The supplemental RF voltage was applied to the electrodes at a frequency of 570 kHz and was ramped over 500 ms (corresponding with a scan speed of approximately 2300 Da/s). No travelling wave pulses were applied to the electrodes in the intermediate region 102 of the ion guide. The buffer gas was helium and was maintained at a pressure of about $3\times10^{-3}$ mbar.

A set-up solution comprising ions of known masses or mass to charge ratios was infused into the ion guide. Ions were ejected from the ion guide into a downstream quadrupole to allow identification of the ejected ions. FIG. 8 shows the normalised peak intensities plotted against apparent mass to charge ratio (calculated by a linear fit of the ejection times to the known masses). FIG. 9 shows the resolutions of the peaks, calculated as m/Δm, where Δm is the FWHM of the peak.

Various further modifications of the present invention are contemplated.

According to an embodiment the primary RF voltage may be ramped instead of ramping the supplemental RF voltage. Additionally/alternatively, the primary RF voltage may be applied to the electrodes with a different repeat unit, pattern or length e.g. ++/−−.

The repeat unit, pattern or length and frequency of the supplemental RF voltage may differ from that of the primary RF voltage.

The DC and/or AC or RF voltage barrier may be arranged to be applied to one or more plates or electrodes.

According to an embodiment the position of the DC and/or AC or RF voltage barrier relative to the repeat unit, pattern or length of the supplemental RF voltage may be varied.

According to an embodiment ions may be retained axially within the ion guide by a DC barrier voltage and/or by a RF barrier voltage.

According to an embodiment ions may be propelled along or through the length of the ion guide in addition to or instead of applying a DC travelling wave to the electrodes. For example, an axial DC voltage gradient may be maintained along at least a portion of the length of the ion guide. Gas flow effects may also be used to urge ions along the length of the ion guide.

According to an embodiment a supplemental RF voltage may be applied only to some of the barrier plates or electrodes.

According to an embodiment a supplemental RF voltage may be applied to differing regions of the device at differing amplitudes.

According to an embodiment the supplemental RF voltage may be applied by different physical means to that of the primary RF e.g. by applying a supplemental RF voltage to one or more vane electrodes.

According to an embodiment travelling wave pulses or DC voltages may also be applied in the exit region of the ion guide to accelerate the exit of ions from the device once they have surmounted the DC and/or RF potential barrier at the exit region of the ion guide.

According to an embodiment the ion guide may comprise a segmented multipole rod set ion guide.

Although the present invention has been described with reference to preferred embodiments, it will be understood by those skilled in the art that various changes in form and detail may be made without departing from the scope of the invention as set forth in the accompanying claims.

The invention claimed is:

1. An ion guide comprising:

a plurality of electrodes;

a first device arranged and adapted to apply a first RF voltage to at least some of said electrodes; and a second device arranged and adapted to apply one or more DC voltages to one or more electrodes in order to maintain one or more axial DC voltage barriers at one or more positions along the ion guide so as to confine at least some ions axially within said ion guide;

wherein said ion guide further comprises:

a third device arranged and adapted to apply a second RF voltage to at least some of said electrodes, wherein two or more axially adjacent electrodes are maintained at a same first RF phase of said second RF voltage and two or more subsequent axially adjacent electrodes are maintained at a same second RF phase of said second RF voltage, said first RF phase of said second RF voltage being different from or opposite to said second RF phase of said second RF voltage; and a fourth device arranged and adapted to progressively increase, linearly increase, or increase in a stepped or other manner an amplitude, height or depth or frequency of either said first RF voltage or said second RF voltage such that at least some of said ions overcome said one or more axial DC voltage barriers and emerge axially from said ion guide.

2. An ion guide as claimed in claim 1, wherein said fourth device is arranged and adapted to progressively increase, linearly increase, or increase in a stepped or other manner the amplitude, height or depth or frequency of either said first RF voltage or said second RF voltage so as to cause at least some ions within said ion guide to become unstable and to gain sufficient axial kinetic energy so as to overcome said one or more axial DC voltage barriers.

3. An ion guide as claimed in claim 1, wherein said first device is arranged and adapted to apply said first RF voltage such that either:

(i) adjacent electrodes are maintained at opposite RF phases; or (ii) two, three, four or more adjacent electrodes are maintained at the same first RF phase of said first RF voltage and two, three, four or more subsequent adjacent electrodes are maintained at the same second RF phase of said first RF voltage, wherein said first RF phase of said first RF voltage is different or opposite to said second RF phase of said first RF voltage and wherein two, three, four or more adjacent electrodes are maintained at the same first RF phase of said second RF voltage and two, three, four or more subsequent adjacent electrodes are maintained at the same second RF phase of said second RF voltage.

4. An ion guide as claimed in claim 1, wherein said first device applies said first RF voltage to at least some of said electrodes with a first RF repeat unit, pattern or length and said third device applies said second RF voltage to at least some of said electrodes with a second RF repeat unit, pattern or length, wherein said second RF repeat unit, pattern or length is greater than said first RF repeat unit, pattern or length.

5. An ion guide as claimed in claim 1, wherein said fourth device is arranged and adapted to cause ions to emerge axially from said ion guide substantially in order of their mass to charge ratio or in a mass to charge ratio dependent manner.

6. An ion guide as claimed in claim 1, wherein said ion guide comprises either:

(i) an ion tunnel ion guide comprising a plurality of electrodes each having an aperture through which ions are transmitted in use; or (ii) a segmented multipole rod set ion guide.

7. An ion guide as claimed in claim 1, further comprising a device arranged and adapted to drive or urge ions along at least a portion of an axial length of said ion guide.

8. An ion guide as claimed in claim 7, wherein said device for driving or urging ions comprises a device for applying one more transient DC voltages or potentials or one or more DC voltage or potential waveforms to at least some or at least 1%, 5%, 10%, 20%, 30%, 40%, 50%, 60%, 70%, 80%, 90%, 95% or 100% of said electrodes.

9. An ion guide as claimed in claim 1, wherein in a mode of operation ions having mass to charge ratios >M1 exit said ion guide whilst ions having mass to charge ratios <M2 are axially trapped or confined within said ion guide by said one or more DC voltage barriers, wherein M1 falls within a first range selected from a group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; and (xi) >1000 and wherein M2 falls with a second range selected from a group consisting of: (i) <100; (ii) 100-200; (iii) 200-300; (iv) 300-400; (v) 400-500; (vi) 500-600; (vii) 600-700; (viii) 700-800; (ix) 800-900; (x) 900-1000; and (xi) >1000.

10. A mass spectrometer comprising an ion guide as claimed in claim 1.

11. A mass spectrometer as claimed in claim 10, further comprising a mass analyser or other device which is scanned in synchronism with mass to charge ratio selective ejection of ions from said ion guide.

12. A method of guiding ions comprising:

providing an ion guide comprising a plurality of electrodes;

applying a first RF voltage to at least some of said electrodes; and applying one or more DC voltages to one or more electrodes in order to maintain one or more axial DC voltage barriers at one or more positions along the ion guide so as to confine at least some ions axially within said ion guide;

wherein said method further comprises:

applying a second RF voltage to at least some of said electrodes, wherein two or more axially adjacent electrodes are maintained at a same first RF phase of said second RF voltage and two or more subsequent axially adjacent electrodes are maintained at a same second RF phase of said second RF voltage, said first RF phase of said second RF voltage being different from or opposite to said second RF phase of said second RF voltage; and progressively increasing, linearly increasing, or increasing in a stepped or other manner an amplitude, height or depth or frequency of either said first RF voltage or said second RF voltage such that at least some of said ions overcome said one or more axial DC voltage barriers and emerge axially from said ion guide.

13. A method of mass spectrometry comprising a method of guiding ions as claimed in claim 12.

14. A mass analyser comprising:

a plurality of electrodes;

a device arranged and adapted to apply a primary RF voltage and a supplemental RF voltage to at least some of said electrodes, wherein said supplemental RF voltage is applied to the electrodes with an axial repeat unit, pattern or length which is greater than that of the primary RF voltage;

a device arranged and adapted to maintain an axial DC voltage barrier at a position along the mass analyser; and a device arranged and adapted to progressively increase an amplitude of the supplemental RF voltage so as to cause ions progressively to overcome said axial voltage barrier.

15. A method of mass analysing ions comprising:

providing a mass analyser comprising a plurality of electrodes;

applying a primary RF voltage and a supplemental RF voltage to at least some of said electrodes, wherein said supplemental RF voltage is applied to the electrodes with an axial repeat unit, pattern or length which is greater than that of the primary RF voltage;

maintaining an axial DC voltage barrier at a position along the mass analyser; and progressively increasing an amplitude of the supplemental RF voltage so as to cause ions progressively to overcome said axial voltage barrier.

16. The ion guide as claimed in claim 1, wherein said fourth device is further arranged and adapted such that said ions emerge in order of increasing mass to charge ratio from said ion guide.

17. The method as claimed in claim 12, wherein progressively increasing, linearly increasing, or increasing in a stepped or other manner the amplitude, height or depth or frequency of said first voltages or said second voltages causes said ions to emerge in order of increasing mass to charge ratio from said ion guide.

* * * * *